US006715629B2

(12) United States Patent
Hartman et al.

(10) Patent No.: US 6,715,629 B2
(45) Date of Patent: Apr. 6, 2004

(54) CAN END FOR A CONTAINER

(75) Inventors: William H. Hartman, Barrington, IL (US); Timothy L. Turner, Pecatonica, IL (US)

(73) Assignee: Rexam Beverage Can Company, Chicago, IL (US)

( * ) Notice: Subject to any disclaimer, the term of this patent is extended or adjusted under 35 U.S.C. 154(b) by 0 days.

(21) Appl. No.: 10/025,198

(22) Filed: Dec. 19, 2001

(65) Prior Publication Data

US 2003/0111469 A1 Jun. 19, 2003

(51) Int. Cl.[7] ..... B65D 17/34

(52) U.S. Cl. ..... 220/269; 220/271; 220/270; 220/906

(58) Field of Search ..... 220/269, 271, 220/906, 276, 270

(56) References Cited

U.S. PATENT DOCUMENTS

| | | | | |
|---|---|---|---|---|
| 4,084,721 A | | 4/1978 | Perry | |
| 4,258,859 A | | 3/1981 | Westphal | |
| 4,530,631 A | | 7/1985 | Kaminski et al. | |
| 4,930,658 A | | 6/1990 | McEldowney | |
| 5,129,541 A | | 7/1992 | Voigt et al. | |
| 5,375,729 A | * | 12/1994 | Schubert | 220/271 |
| 5,653,355 A | | 8/1997 | Tominaga et al. | |
| 5,692,636 A | * | 12/1997 | Schubert | 220/271 |
| 5,738,237 A | | 4/1998 | McEldowney | |
| 5,860,553 A | * | 1/1999 | Schubert | 220/271 |
| 5,927,536 A | * | 7/1999 | Oyagi et al. | 220/266 |
| 6,024,239 A | | 2/2000 | Turner et al. | |
| 2002/0113069 A1 | * | 8/2002 | Forrest et al. | 220/269 |

FOREIGN PATENT DOCUMENTS

| | | |
|---|---|---|
| EP | 0 433 235 A1 | 12/1990 |
| EP | 0 621 195 A2 | 4/1994 |
| EP | 0 811 441 A1 | 12/1997 |
| WO | WO 98/22355 | 5/1998 |

* cited by examiner

*Primary Examiner*—Lee Young
*Assistant Examiner*—James Smalley
(74) *Attorney, Agent, or Firm*—Wallenstein, Wagner & Rockey, Ltd.

(57) ABSTRACT

An end member for a container. The end member has a central panel wall with a public side and an opposing product side. The public side includes a means for opening a frangible panel segment. The member also has a score groove and a coin segment. The score groove is located on the public side of the end member and defines an outer perimeter of the frangible panel segment and separates the frangible panel segment from a non-frangible portion of the public side. The coin segment is adjacent the score groove and places a compressive stress on a portion of the end member located between the coin segment and the score groove wherein an upper plane and a lower plane are formed and separated by the score groove. The lower plane comprises a portion of the frangible panel segment adjacent the score groove.

35 Claims, 3 Drawing Sheets

200X

200X

CAN END FOR A CONTAINER

TECHNICAL FIELD

The present invention relates to end closures for two-piece beer and beverage metal containers having a non-detachable operating panel. More specifically, the present invention relates to forming techniques for improving the openability of a lightweight end closure.

BACKGROUND OF THE INVENTION

Common end closures for beer and beverage containers have a central panel that has a frangible panel (sometimes called a "tear panel," "opening panel," or "pour panel") defined by a score formed on the outer surface, the "consumer side," of the end closure. Popular "ecology" can ends are designed to provide a way of opening the end by fracturing the scored metal of the panel, while not allowing separation of any parts of the end. For example, the most common such beverage container end has a tear panel that is retained to the end by a non-scored hinge region joining the tear panel to the remainder of the end, with a rivet to attach a leverage tab provided for opening the tear panel. This type of container end, typically called a "stay-on-tab" ("SOT") end has a tear panel that is defined by an incomplete circular-shaped score, with the non-scored segment serving as the retaining fragment of metal at the hinge-line of the displacement of the tear panel.

The container is typically a drawn and ironed metal can, usually constructed from a thin plate of aluminum. End closures for such containers are also typically constructed from a cut-edge of thin plate of aluminum or steel, formed into a blank end, and manufactured into a finished end by a process often referred to as end conversion. These ends are formed in the process of first forming a cut-edge of thin metal, forming a blank end from the cut-edge, and converting the blank into an end closure which may be seamed onto a container. Although not presently a popular alternative, such containers and/or ends may be constructed of plastic material, with similar construction of non-detachable parts provided for openability.

These containers are typically filled with carbonated beverages that create a substantial pressure within the container. Upon opening the container, this pressure must be quickly and safely vented. For this reason can ends are constructed for venting or releasing the internal pressure of the container during the initial opening of the container.

When the tab is lifted, an upward force is placed on a rivet that attaches the tab to the end, and a downward force is placed on the tear panel. This causes an initial opening of the tear panel beneath the nose of the tab in an area referred to as the vent region of the can end. Further lifting of the tab causes the tear panel to separate progressively along the score.

Upon fracturing of the vent region, rapid disassociation of the tear panel from the end panel, or more simply, the "missiling" of the tear panel may occur. For this reason, some manufacturers place anti-missile features on the consumer side of the can end.

One such feature consists of a vent coin inside the score line. This feature causes localized compression. This score compression causes the edge of the tear panel to move over the end panel as illustrated in FIG. 4 of the drawings. Thus, the anti-missile feature and score help prevent the rapid disassociation of the tear panel from the end panel when the end is opened under the pressure provided by the carbonated beverage in the can.

SUMMARY OF THE INVENTION

It is an object of the present invention to provide an end closure for a container having an improved openability and resistance to missiling. The end closure includes a vent coin. The vent coin is a substantially obround shaped coin located adjacent to a score groove. The vent coin displaces metal of a large enough area to cold work a residual metal between the score groove and a product side of the end closure. This causes an elastic, compressive state.

The vent coin of the present invention collapses the score groove. This is accomplished by moving the vent coin outside of a tear panel defined by the score groove and on the public side of the end closure. A similar result is reached when the vent coin is provided on the tear panel but on the product side of the end closure rather than the public side.

The tear panel is slightly tucked below the adjacent portion of the end closure. A first plane of metal defined by the tear panel underlaps a second plane of metal defined by the region of the end closure on the opposite side if the score groove as the tear panel. This is accomplished by placing the vent coin in a location where the residual metal between the score groove and the product side is cold worked such that a flow of plastically deformed residual metal is forced inwardly and over the tear panel.

Other features and advantages of the invention will be apparent from the following specification taken in conjunction with the following drawings.

DETAILED DESCRIPTION

Figure 1:
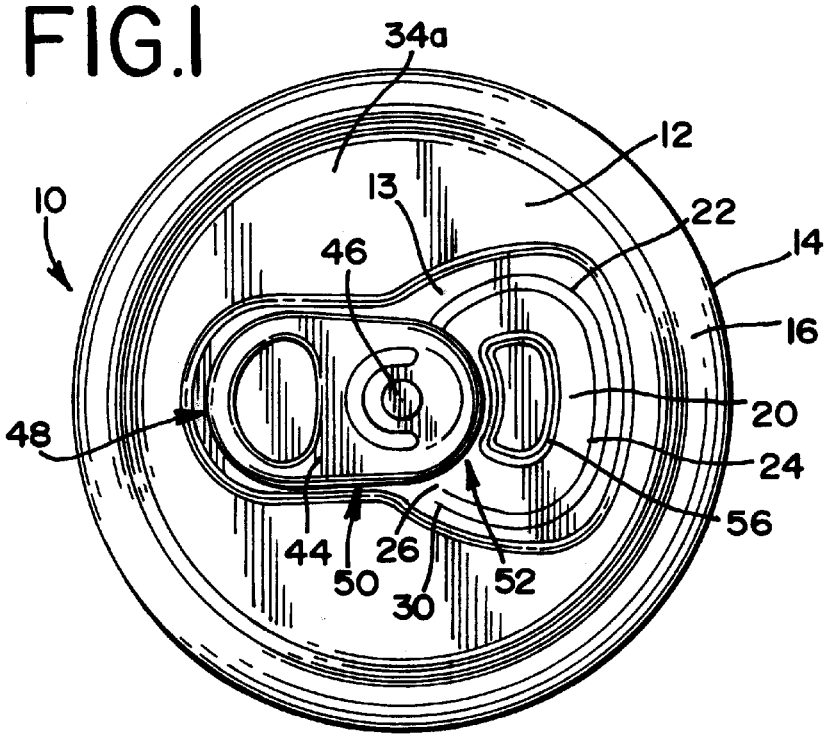
FIG. 1 is a top view of a can end of the present invention.

While this invention is susceptible of embodiment in many different forms, there are shown in the drawings and will herein be described in detail preferred embodiments of the invention with the understanding that the present disclosure is to be considered as an exemplification of the principles of the invention and is not intended to limit the broad aspect of the invention to the embodiments illustrated.

The container end of the present invention is a stay-on-tab end member 10 with improved physical properties including strength. Essentially, the present invention provides a lightweight end member 10 which embodies the physical characteristics and properties required in the beverage container market, as explained below.

Figure 2:
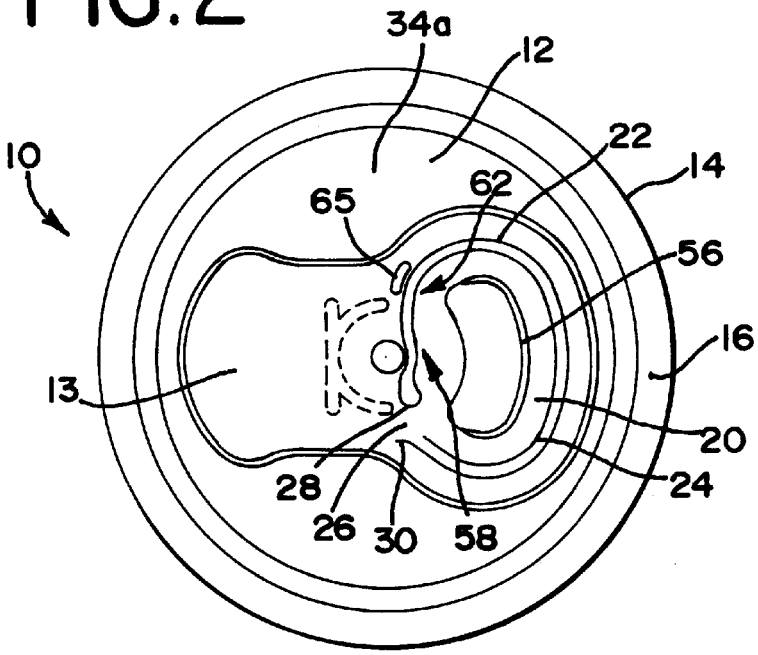
FIG. 2 is a top view of a can end of the present invention without a tab.
Figure 3:
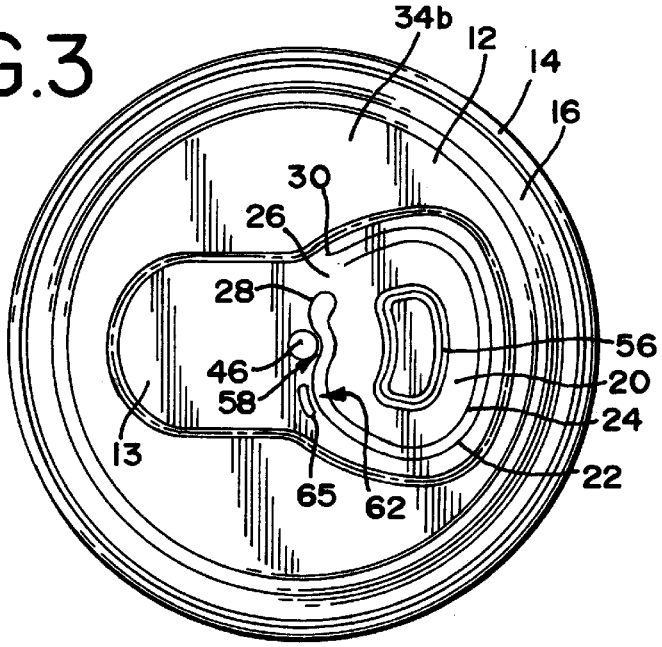
FIG. 3 is a bottom view of a can end of the present invention.

Referring to FIGS. 1 and 2, the end member 10 for a container (not shown) has a central panel 12 having a seaming curl 14 for joining the wall to the container. The container is typically a drawn and ironed metal can, usually constructed from a thin plate of aluminum or steel, such as the common beer and beverage containers. End closures for such containers are also typically constructed from a cut edge of thin plate of aluminum or steel, formed into blank end, and manufactured into a finished end by a process often referred to as end conversion. In the embodiment shown in the Figures, the central panel 12 is joined to a container by a seaming curl 14 which is joined to a mating curl of the container. The seaming curl 14 of the end closure 10 is integral with the central panel 12 by a countersink area 16 which is joined to the panel outer peripheral edge of the central panel 12. This type of means for joining the central panel 12 to a container is presently the typical means for joining used in the industry, and the structure described above is formed in the process of forming the blank end from a cut edge of metal plate, prior to the end conversion process. However, other means for joining the central panel 12 to a container may be employed with the present invention.

The central panel wall 12 has a displaceable tear panel 20 defined by a curvilinear frangible score 22 with an adjacent anti-fracture score 24 on the tear panel 20, and a non-frangible hinge segment 26. The hinge segment 26 is defined by a generally straight line between a first end 28 and a second end 30 of the frangible score 22. The tear panel 20 of the central panel 12 may be opened, that is the frangible score 22 may be severed and the tear panel 20 displaced at an angular orientation relative to the remaining portion of the central panel 12, while the tear panel 20 remains hingedly connected to the central panel 12 through the hinge segment 26. In this opening operation, the tear panel 20 is displaced at an angular deflection, as it is opened by being displaced away from the plane of the panel 12.

The frangible score 22 is preferably a generally V-shaped groove formed into the public side 34*a* of the panel wall 12. Similarly, the anti-fracture score 24, is preferably a generally V-shaped groove formed into the public side 34*a* of the panel wall 12 on the tear panel 20. As is explained in more detail below, the frangible score groove 22 is preferably deeper than the anti-fracture score groove 24. Accordingly, the score residual, being the amount of frangible material remaining below the frangible score groove 22, is less than the adjacent anti-fracture score residual. This difference between score residual and adjacent anti-fracture score residual is the score residual differential.

The frangible score 22 and the second groove or anti-fracture score 24 are formed using conventional-type of scoring operation during the can end forming process, using tools that include an upper (public side) die with a score knife and a lower (product side) die with an anvil surface.

The score residual differential is adapted to provide a tear panel 20 with a score 22 more readily frangible than the anti-fracture score 24, a significant factor for providing efficient opening of the end member 10. Having a double score of a frangible score 22 and an anti-fracture score 24 wherein there is a score residual differential is common in the industry.

The stay-on-tab end member 10 has a tab 44 secured to the end panel 12 adjacent the tear panel 20 by a rivet 46. The tab 44 has a lift end 48, a central region 50, and a nose portion 52. The lift end 48 and the nose portion 52 are generally aligned along a central longitudinal axis passing through the rivet 44. A bead 56 is optionally formed in the tear panel 20 inward of the score 22 and the anti-fracture score 24. The tear panel bead 56 is useful to draw excess metal, or slack of metal, from the tear panel 20 to tighten the metal of the tear panel 20 and improve opening characteristics of the end member 10 by the tab 44 being lifted to push against the tear panel 20.

The rivet 46 is formed in the typical manner. It is the conventional practice to coin the metal on the central panel 12 proximate the base of the rivet 46 during formation thereof. When the rivet 46 is completely formed in the central panel 12, a button coin band having a generally circular periphery is also formed and is located about the rivet 46.

During opening of the end member 10 by the user, the user lifts the lift end 48 of the tab 44 to displace the nose portion 52 downward against the tear panel 20. The force of the nose portion 52 against the tear panel 20 causes the score 22 to fracture, typically in a vent region 58 of the tear panel 20. As the tab 44 displacement is continued, the fracture of the score 22 propagates around the tear panel 20, preferably in progression from the first end 28 of the score 22 toward the second end 30 of the score 22.

The frangible score 22 includes a check slot region 62 within the vent region 58. The check slot region 62 includes an area of thickened residual. The thickened residual causes the propagation of the fracture of the frangible score 22 to slow naturally as the fracture reaches the check slot region 62. This allows the container to vent safely before the fracture of the frangible score 22 continues.

Preferably, the check slot region 62 includes a duel step residual differential. The dual step residual differential includes two levels of residual thickness. Thus, the check slot region 62, rather than having a constant residual thickness, includes a first step wherein the residual is approximately 0.0023 inches and greater and a second step wherein the residual is approximately 0.0016 inches greater than the score residual.

The end member 10 also includes a vent coin 65 (see FIG. 2). The vent coin 65 is a substantially obround shaped coin, as differentiated from a score, placed near the frangible score 22. The vent coin 65 may also be curved slightly to approximate the shape of the frangible score 22. The vent coin 65 differs from a vent score in that the vent coin 65 causes displacement of the metal on the bottom or product side of the can end 10. Further, the vent coin 65 can be rectangular or other shapes without departing from the spirit of the invention.

One purpose of the vent coin 65 is to prevent the tear panel 20 from missiling during the opening of the container. Missiling is a jutting upward of the tear panel 20 upon venting. Missiling is caused when the frangible score 22 fracture propagates beyond the vent region 58, before the container pressure is fully relieved. The loose tear panel 20 is then forced upward due to the internal pressure of the container.

As the lift end 48 of the tab 44 is raised, a downward force is applied by the nose of the tab 44 to the tear panel 20. This action also creates an upward force at the rivet 46. These actions sever the frangible score 22 only in the vent region 58. This allows a small portion of the tear panel 20 metal to be pushed below the deboss panel 13 to open and vent the pressure within the container.

Figure 5:
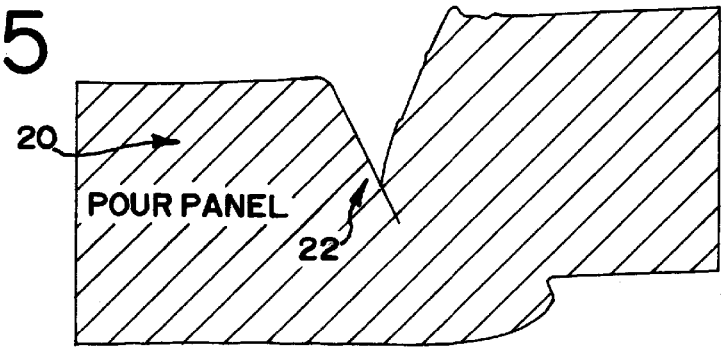
FIG. 5 is a photomicrograph of a score groove of the present invention.

As shown in FIG. 5, the vent coin 65 displaces or compresses the metal near in the score residual, adjacent to the vent region 58 and is of a large enough area to cold work the residual metal between the score 22 and the product side of the can end. This causes an elastic, compressive state. As such, when the frangible score 22 is severed in the vent region 58, the metal of the tear panel 20 springs out to underlap the metal of the deboss panel 13 in that region. This underlapping portion of the tear panel 20 is believed to keep the remainder of the tear panel 20 in place so as to avoid premature fracture of the remainder of the frangible score 22 and thereby prevent the tear panel 20 from missiling, without appreciably increasing the force necessary to propagate the fracture of the score 22 about the tear panel 20. This underlapping of the metal may eliminate the need for the check slot 62, or raised residual area which is typically employed with anti-missiling features in this area.

Figure 4:
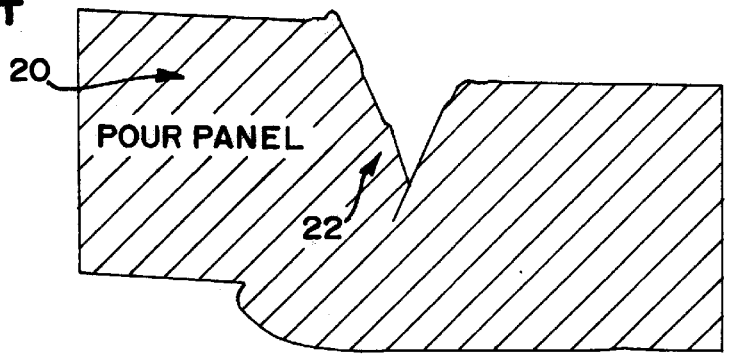
FIG.4 (Prior Art)
FIG. 4 is a photomicrograph of a prior art score groove.

As illustrated in FIG. 4, the vent coin 65 is typically located within the tear panel 20 on the public side of the can end 10. Placing the vent coin 65 in this location causes the score 22 to collapse which "locks" the tear panel. This design causes the tear panel 20 to overlap the adjacent portion of the can end 10 as the residual metal between the frangible score 22 and the product side is cold worked so that a flow of metal is displaced outwardly toward the deboss panel 13. This increases the opening push force required to propagate the fracturing of the score 22 because it is more difficult to push the tear panel 20 down through the collapsed score 22 configuration. The missile resistance is also limited because the tear panel 20 side of the score 22 collapses over, rather than under, the adjacent metal of the can end.

Figure 6:
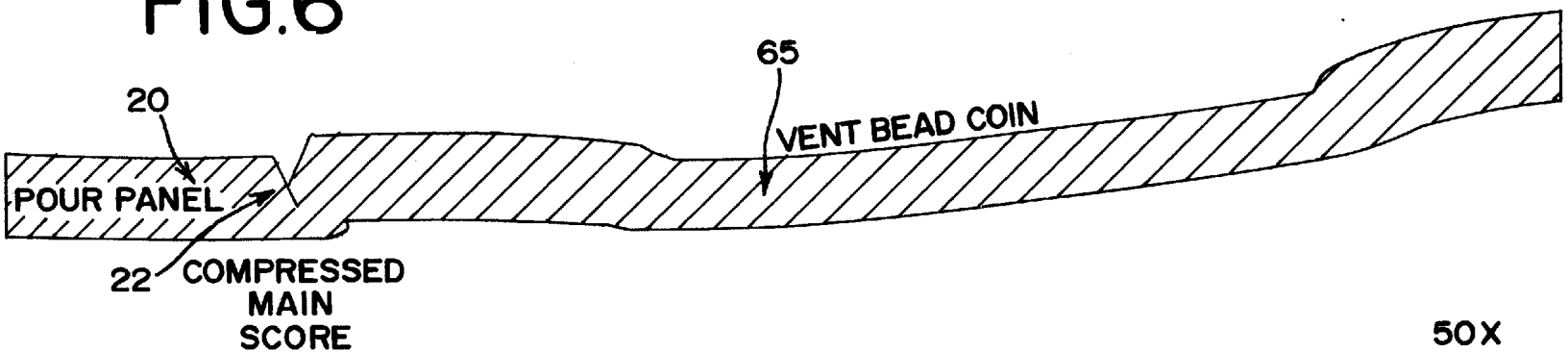
FIG. 6 is a photomicrograph of a score groove of the present invention showing the vent coin on the public side and beyond the perimeter of the tear panel.
Figure 7:
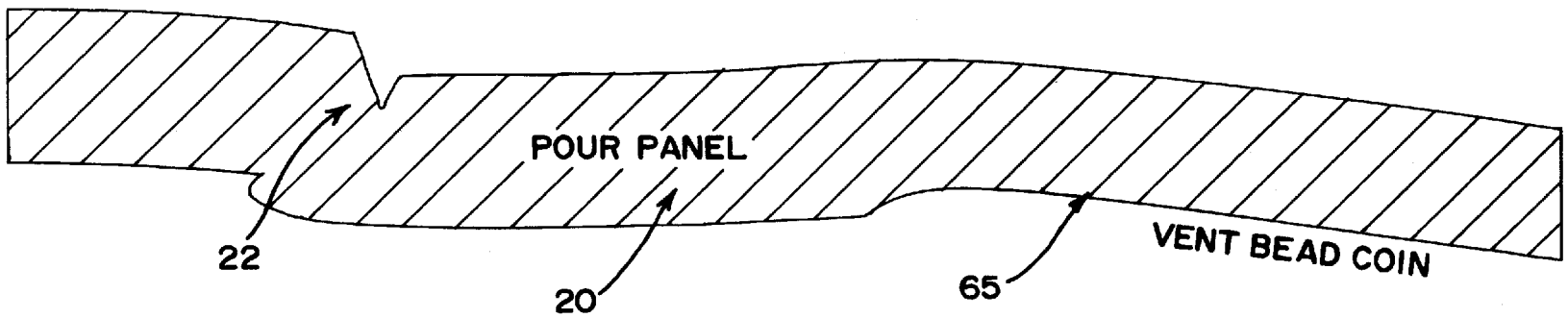
FIG. 7 is a photomicrograph of a score groove of the present invention showing the vent coin on the product side and within the perimeter of the tear panel.

As shown in FIGS. 5–7, the vent coin 65 of the present invention collapses the score 22 in the opposite manner. This is accomplished by moving the vent coin 65 outside of the tear panel 20 and on the public side of the can end as shown in FIG. 6. In an alternate embodiment shown in FIG. 7, a similar result is reached when the vent coin 65 is provided on the tear panel 20 but on the product side of the can end 10 rather than the public side.

It is believed that the opening of an end be improved by moving the vent coin 65 to a location where the tear panel 20 is slightly tucked below the adjacent portion of the can end. In other words, a first plane of metal defined by a portion of the tear panel 20 underlaps a second plane of metal defined by a portion of the non-frangible portion of the central panel 12 of the can end. This is accomplished by placing the vent coin 65 in a location wherein the residual metal between the frangible score 22 and the product side is cold worked such that a flow of plastically deformed residual metal from the tear panel 20 is forced under the end metal 10.

Resistance to missiling is increased because the tear panel 20 metal is naturally tucked under the adjacent metal of the can end 10. This arrangement may also eliminate the need for the check slot 62 which is provided to improve resistance to missiling but has the disadvantage of increasing opening force.

While the invention has been described with reference to a preferred embodiment, it will be understood by those skilled in the art that various changes may be made and equivalents may be substituted for elements thereof without departing from the broader aspects of the invention. Also, it is intended that broad claims not specifying details of a particular embodiment disclosed herein as the best mode contemplated for carrying out the invention should not be limited to such details.

We claim:

1. An end member for a container comprising:

a compressible material;

a central panel wall of the compressible material, the central panel wall comprising a public side and an opposing product side:

a frangible panel segment located on the central panel wall;

a score groove on the public side forming an outer perimeter of the frangible panel segment;

a residual thickness of the compressible material separating the score groove from the product side of the central panel; and a plastically deformed segment of the residual thickness located outwardly of the frangible panel segment relative to the score groove.

2. The end member of claim 1 wherein the plastically deformed segment further includes a portion of the frangible panel segment, the portion of the frangible panel segment located outwardly of the score groove and along the product side of the central panel.

3. The end member of claim 1 wherein the compressible material is coined in an area adjacent the score groove to cause the plastically deformed segment.

4. The end member of claim 3 wherein the frangible panel segment comprises the coined compressible material that causes the plastically deformed segment.

5. The end member of claim 4 wherein the product side of the frangible panel segment is coined to cause the plastically deformed segment.

6. The end member of claim 3 wherein the coined compressible material that causes the plastically deformed segment is located beyond the outer perimeter of the frangible panel segment.

7. The end member of claim 6 wherein the public side of the central panel wall is coined to cause the plastically deformed segment.

8. An end member for a container comprising:

a compressible material;

a central panel wall of the compressible material, the central panel wall comprising a public side and an opposing product side:

a frangible panel segment;

a score groove on the public side of the central panel separating the frangible panel segment from a remaining portion of the public side of the central panel;

a coin segment adjacent the score groove and compressing the compressible material; and a residual thickness of the compressible material separating the score groove from the product side;

a plastically deformed region including a portion of the frangible panel segment located radially outwardly of the score groove and adjacent the product side of the central panel.

9. The end member of claim 8 wherein the coin segment is located within an outer perimeter of the frangible panel segment.

10. The end member of claim 9 wherein the coin segment is further located on the product side of the frangible panel segment.

11. The end member of claim 8 wherein the coin segment is located beyond an outer perimeter of the frangible panel.

12. The end member of claim 11 wherein the coin segment is further located on the public side of the central panel wall.

13. The end member of claim 8 wherein the coin segment has a curvilinear shape.

14. The end member of claim 13 wherein the coin segment is substantially obround.

15. The end member of claim 8 wherein the coin segment comprises first and second end portions separated by first and second opposing side walls.

16. The end member of claim 15 wherein the first and second end portions have an annular shape.

17. The end member of claim 15 wherein the first side wall has a portion having a shape corresponding to an adjacent portion of the score groove.

18. The end member of claim 17 wherein the second side wall has a shape similar to the first side wall.

19. The end member of claim 8 wherein the coin segment includes first and second opposing side walls spaced by first and second annular end walls.

20. The end member of claim 19 wherein the first and second opposing side walls have a length longer than the first and second annular end walls.

21. An end member for a container, the end member comprising a central panel wall with a public side and an opposing product side, the public side comprising a means for opening a frangible panel segment, the end member comprising:

a score groove on the public side of the end member defining an outer perimeter of the frangible panel segment and separating the frangible panel segment from a non-frangible portion of the public side, and separated from the product side by a residual thickness;

a coin segment adjacent the score groove, the coin segment placing a compressive stress on a portion of the end member located between the coin segment and the score groove wherein an upper plane and a lower plane are formed and separated by the score groove, the lower plane comprising a portion of the frangible panel segment and a portion of the residual thickness.

22. The end member of claim 20 the coin segment is located within the outer perimeter of the frangible panel segment.

23. The end member of claim 21 wherein the coin segment is further located on the product side of the frangible panel segment.

24. The end member of claim 20 wherein the coin segment is located beyond the outer perimeter of the frangible panel.

25. The end member of claim 24 wherein the coin segment is further located on the public side of the central panel wall.

26. An end member for a container, the end member comprising a central panel wall with a public side and an opposing product side, the public side comprising a means for opening a frangible panel segment, the end member comprising:

a score groove on the public side of the end member defining an outer perimeter of the frangible panel segment;

a residual thickness separating the score groove from the product side;

a first plane comprising a portion of the frangible panel segment and a portion of the residual thickness;

a second plane separated from the first plane by the score groove;

a coin segment adjacent the score groove for displacing a portion of the first plane under a portion of the second plane.

27. The end member of claim 26 wherein the coin segment is located within the outer perimeter of the frangible panel segment.

28. The end member of claim 27 wherein the coin segment is further located on the product side of the frangible panel segment.

29. The end member of claim 26 wherein the coin segment is located beyond the outer perimeter of the frangible panel.

30. The end member of claim 29 wherein the coin segment is further located on the public side of the central panel wall.

31. An end member for a container comprising:

a metallic material;

a central panel wall of the metallic material, the central panel wall comprising a public side and an opposing product side, the public side comprising a score groove, a frangible segment and a means for opening the frangible panel segment, the score groove defining an outer perimeter of the frangible panel segment and separated from the product side by a residual thickness of the metallic material; and a coin segment spaced from the score groove, the coin segment compressing the metallic material wherein a product side portion of the frangible panel segment is located outwardly of the score groove.

32. The end member of claim 31 wherein the coin segment is located within the outer perimeter of the frangible panel segment.

33. The end member of claim 32 wherein the coin segment is further located on the product side of the frangible panel segment.

34. The end member of claim 31 wherein the coin segment is located beyond the outer perimeter of the frangible panel.

35. The end member of claim 34 wherein the coin segment is further located on the public side of the central panel wall.

* * * * *